US010895231B2

(12) United States Patent
Lopez et al.

(10) Patent No.: US 10,895,231 B2
(45) Date of Patent: Jan. 19, 2021

(54) FUEL INJECTOR NOZZLE ASSEMBLY HAVING ANTI-CAVITATION VENT AND METHOD

(71) Applicant: Progress Rail Services Corporation, Albertville, AL (US)

(72) Inventors: Rolando Lopez, Lehigh Acres, FL (US); Pitchaiah Potluru, Naples, FL (US); Edward Schlairet, Guyton, GA (US)

(73) Assignee: Progress Rail Services Corporation, Albertville, AL (US)

( * ) Notice: Subject to any disclaimer, the term of this patent is extended or adjusted under 35 U.S.C. 154(b) by 0 days.

(21) Appl. No.: 16/440,496

(22) Filed: Jun. 13, 2019

(65) Prior Publication Data

US 2020/0392928 A1 Dec. 17, 2020

(51) Int. Cl.

*F02M 61/18* (2006.01)
*F02M 57/02* (2006.01)
*F02M 45/06* (2006.01)

(52) U.S. Cl.

CPC ..... *F02M 57/023* (2013.01); *F02M 45/066* (2013.01); *F02M 61/18* (2013.01)

(58) Field of Classification Search

CPC ..... F02M 57/023; F02M 45/066; F02M 61/18
USPC ..... 123/468–470; 239/533.11, 533.12, 239/533.13, 584
See application file for complete search history.

(56) References Cited

U.S. PATENT DOCUMENTS 3,836,080 A 9/1974 Butterfield et al.
4,576,338 A * 3/1986 Klomp ..... F02M 61/18 137/853
5,333,786 A * 8/1994 Gant ..... F02M 57/024 123/446
5,954,033 A 9/1999 Moncelle
6,247,450 B1 * 6/2001 Jiang ..... F02M 57/023 123/446
6,491,237 B1 12/2002 Coppola et al.
6,543,706 B1 4/2003 Hutchings et al.
6,745,952 B1 6/2004 Hlousek
6,776,353 B2 8/2004 Moorthy et al.
6,811,092 B2 * 11/2004 Cowden ..... F02M 45/12 239/533.3
6,843,434 B2 * 1/2005 Lawrence ..... F02M 45/086 239/533.11
6,966,499 B2 11/2005 Nally et al.
(Continued)

FOREIGN PATENT DOCUMENTS

JP 2005113889 4/2005

*Primary Examiner* — Hai H Huynh
(74) *Attorney, Agent, or Firm* — Brannon Sowers & Cracraft

(57) ABSTRACT

A nozzle assembly for a fuel injector includes an injector housing having a casing and a stack within the casing, an outlet check movable within a nozzle cavity in the injector housing, and having a stop positioned within a stop cavity. A clearance is formed between the outlet check and the injector housing and fluidly connects a spring cavity to a stop cavity, and an anti-cavitation vent is formed in the stack and fluidly connects the spring cavity to a low pressure space. The anti-cavitation vent limits pressure changes in the spring cavity during fuel injection such that production of cavitation bubbles in the spring cavity is limited.

20 Claims, 5 Drawing Sheets

(56) References Cited

U.S. PATENT DOCUMENTS

| | | | | |
|---|---|---|---|---|
| 7,004,406 | B2 * | 2/2006 | Yang | F02M 57/025 239/533.12 |
| 7,134,615 | B2 | 11/2006 | Lawrence | |
| 2010/0051723 | A1 | 3/2010 | Jones | |
| 2018/0306154 | A1 | 10/2018 | Lopez | |

* cited by examiner

FUEL INJECTOR NOZZLE ASSEMBLY HAVING ANTI-CAVITATION VENT AND METHOD

TECHNICAL FIELD

The present disclosure relates generally to a fuel injector for an internal combustion engine, and more particularly to a fuel injector nozzle assembly having an anti-cavitation vent for a spring chamber.

BACKGROUND

Fuel injectors have been used in a great many different types of internal combustion engines for over a century. In many modern designs, a valve member commonly referred to as an outlet check or by similar terms is positioned within a fuel injector housing, and operated to connect high pressure fuel in an internal fuel passage, or in an external fuel supply, with fuel spray orifices in fluid communication with a combustion chamber. Some outlet check designs are directly controlled, where hydraulic pressure is selectively applied and relieved upon a closing hydraulic surface of the outlet check, to enable pressurized fuel to actuate the outlet check open and selectively inject fuel into the combustion chamber. Other designs are not directly controlled, and when fuel in a nozzle chamber acting on opening hydraulic surfaces of an outlet check reaches a sufficient pressure, the outlet check is hydraulically actuated open in opposition to a biasing force of a biasing spring. Almost innumerable different outlet check designs have been built around these general principles.

As is the case in many fluid systems experiencing fluid pressures of relatively high magnitude, and particularly fluid pressure changes of relatively high magnitude, a phenomenon known as cavitation can be observed. Where a pressure of a liquid drops below a vapor pressure of the liquid vapor bubbles can form, and then collapse when pressure increases above the vapor pressure. Collapsing of cavitation bubbles has been observed to cause erosion of internal fuel injector surfaces, potentially leading to performance degradation or even failure. Various strategies for mitigating cavitation in fuel injectors have been proposed over the years, including the placement of flow restrictions, vents, pressure accumulators, and other features to prevent pressure excursions that can lead to cavitation phenomena. With ever-changing fuel system designs to meet more stringent emissions and fuel efficiency standards, increased operating and injection pressures, and higher travel speeds of components, engineers are always searching for new strategies for improving performance and service life, including management of cavitation phenomena. One known fuel injector and fuel system design is set forth in United States Patent Application Publication No. 2018/0306154 A1 to Lopez.

SUMMARY OF THE INVENTION

In one aspect, a nozzle assembly for a fuel injector includes an injector housing having a casing defining a longitudinal axis, and a stack within the casing. The stack includes a nozzle end piece and at least one mid piece, and having formed therein a nozzle supply passage, a nozzle cavity, a plurality of spray orifices, a spring cavity, and a stop cavity. The nozzle assembly further includes an outlet check having a tip positioned within the nozzle cavity, a stop positioned within the stop cavity, and an opening hydraulic surface exposed to a fluid pressure of the nozzle cavity. The outlet check is movable between a closed position where the tip contacts the injector housing to block the plurality of spray orifices, and an open position where the stop contacts the injector housing. The nozzle assembly further includes a biasing spring positioned within the spring cavity and coupled to the outlet check to bias the outlet check toward the closed position. A clearance is formed between the outlet check and the injector housing and fluidly connects the spring cavity to the stop cavity, the clearance having a first flow area. The stack further has an anti-cavitation vent formed in the at least one mid piece, the anti-cavitation vent fluidly connecting the spring cavity to a low pressure space and having a second flow area that is less than the first flow area.

In another aspect, a fuel injector for an internal combustion engine includes an injector housing having a longitudinal axis and having formed therein a plunger cavity, a nozzle supply passage, a nozzle cavity, a plurality of spray orifices, a spring cavity, and a stop cavity. A plunger is movable within the plunger cavity to pressurize a fuel for injection. The fuel injector further includes an outlet check having a tip positioned within the nozzle cavity, a stop positioned within the stop cavity, and an opening hydraulic surface exposed to a fluid pressure of the nozzle cavity. The outlet check is movable between a closed position where the tip contacts the injector housing to block the plurality of spray orifices, and an open position where the stop contacts the injector housing. The fuel injector further includes a biasing spring positioned within the spring cavity and coupled to the outlet check to bias the outlet check toward the closed position. A clearance is formed between the outlet check and the injector housing and fluidly connects the spring cavity to the stop cavity. An anti-cavitation vent is formed in the injector housing and structured to limit fluid pressure changes in the spring cavity. The anti-cavitation vent fluidly connects the spring cavity to a low pressure space, such that fluid is displaced from the spring cavity through the anti-cavitation vent in response to positioning the outlet check at the open position, and fluid is returned through the anti-cavitation vent to the spring cavity in response to commencing moving the outlet check from the open position back to the closed position.

In still another aspect, a method of operating a fuel injector for an internal combustion engine includes increasing a pressure of fuel in a nozzle cavity in the fuel injector, actuating an outlet check in the fuel injector to an open position in response to the increased pressure of fuel in the nozzle cavity, and displacing fuel in a spring cavity in the fuel injector to a low pressure space in response to positioning the outlet check at the open position. The method further includes reducing a pressure of fuel in the nozzle cavity, and commencing actuating the outlet check back to a closed position in response to the reduction in the pressure of fuel in the nozzle cavity using a biasing spring in the fuel injector. The method still further includes returning fuel to the spring cavity from the low pressure space in response to the commencing of the actuating of the outlet check back to the closed position, and conveying the returning fuel to the spring cavity through an anti-cavitation vent in the fuel injector such that production of cavitation bubbles in the spring cavity is limited.

DETAILED DESCRIPTION

Figure 1:
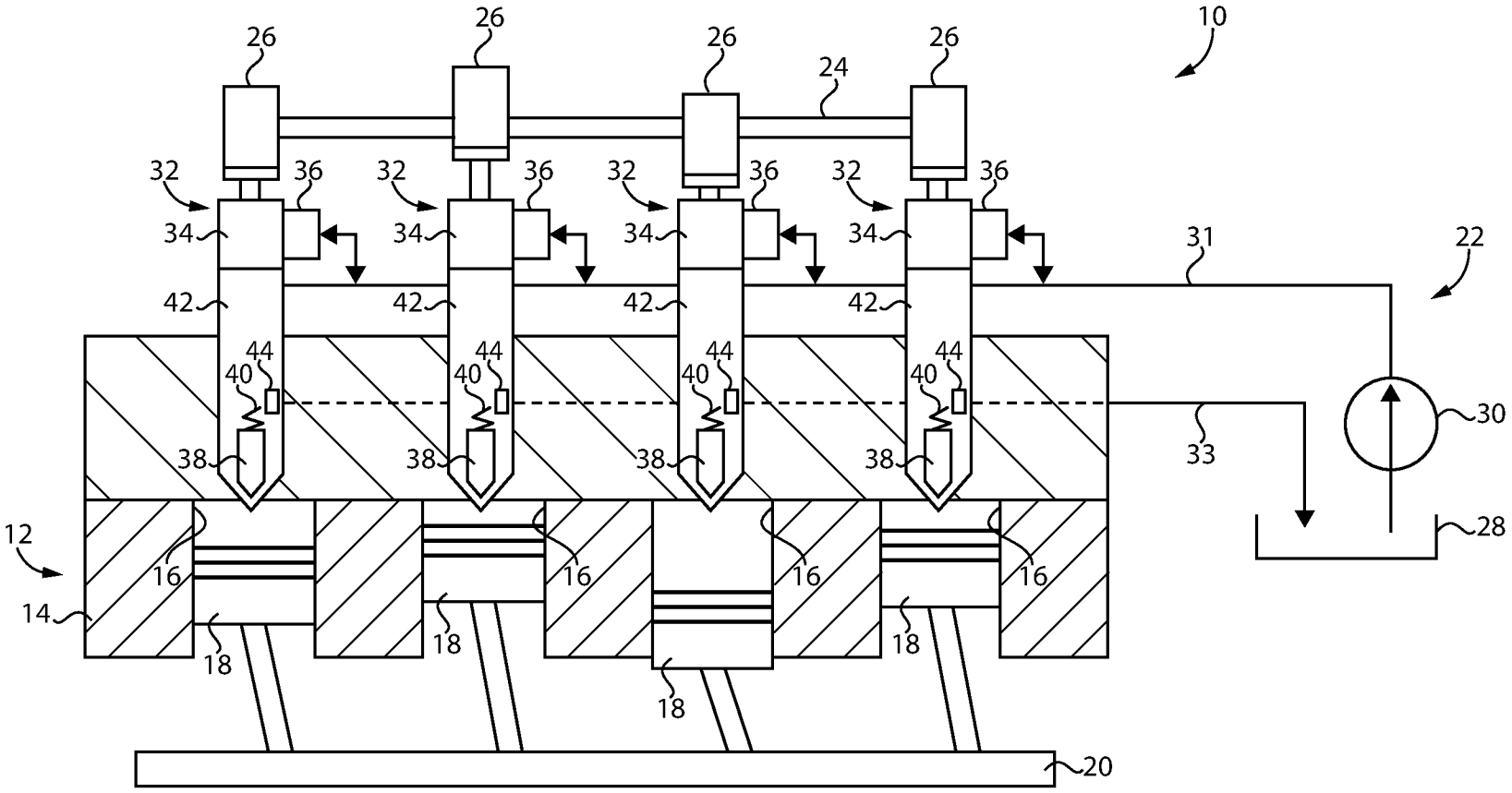
FIG. 1 is a diagrammatic view of an internal combustion engine system, according to one embodiment.

Referring to FIG. 1, there is shown an internal combustion engine system 10 according to one embodiment and including an internal combustion engine 12 having an engine housing 14 with a plurality of cylinders formed therein. Cylinders 16 may be in any suitable arrangement such as a V-pattern, an in-line pattern, or still another. A plurality of pistons 18 are each positioned within one of cylinders 16 and movable between a bottom dead center position and a top dead center position in a conventional four-cycle or two-cycle pattern. Engine 12 can include a compression ignition internal combustion engine where pistons 18 increase a pressure within cylinders 16 to an autoignition threshold for fuel and air. Pistons 18 are coupled with a crankshaft 20 in a generally conventional manner. Engine 12 may be structured to operate on a suitable compression ignition fuel such as diesel distillate fuel, biodiesel, blends of these, or still others. Engine system 10 further includes a fuel system 22 including a cam 24 having a plurality of cam lobes 26 and rotatable typically at one-half engine speed. Fuel system 22 also includes a fuel supply or tank 28 and a fuel transfer pump 30 structured to supply fuel from tank 28 to a fuel supply conduit 31 that feeds the fuel to a plurality of fuel injectors 32. Fuel supply conduit 31 may be formed at least in part within an engine head of engine housing 14. A fuel drain conduit 33 extends from engine housing 14 back to tank 28.

Each of fuel injectors 32 further includes a cam-actuated fuel pump 34 associated with one of cam lobes 26. Each of fuel injectors 32 further includes a spill valve 36 in the illustrated embodiment. Pumps 34 may be attached to fuel injectors 32 or configured as a separate apparatus. Each of fuel injectors 32 further includes an outlet check 38 and a biasing spring 40, with outlet checks 38 and biasing springs 40 positioned along with other components within an injector housing 42. Each fuel injector 32 further includes an anti-cavitation vent 44 to eliminate or reduce cavitation phenomena that have been observed in association with check biasing springs in certain earlier designs, as further discussed herein.

Figure 2:
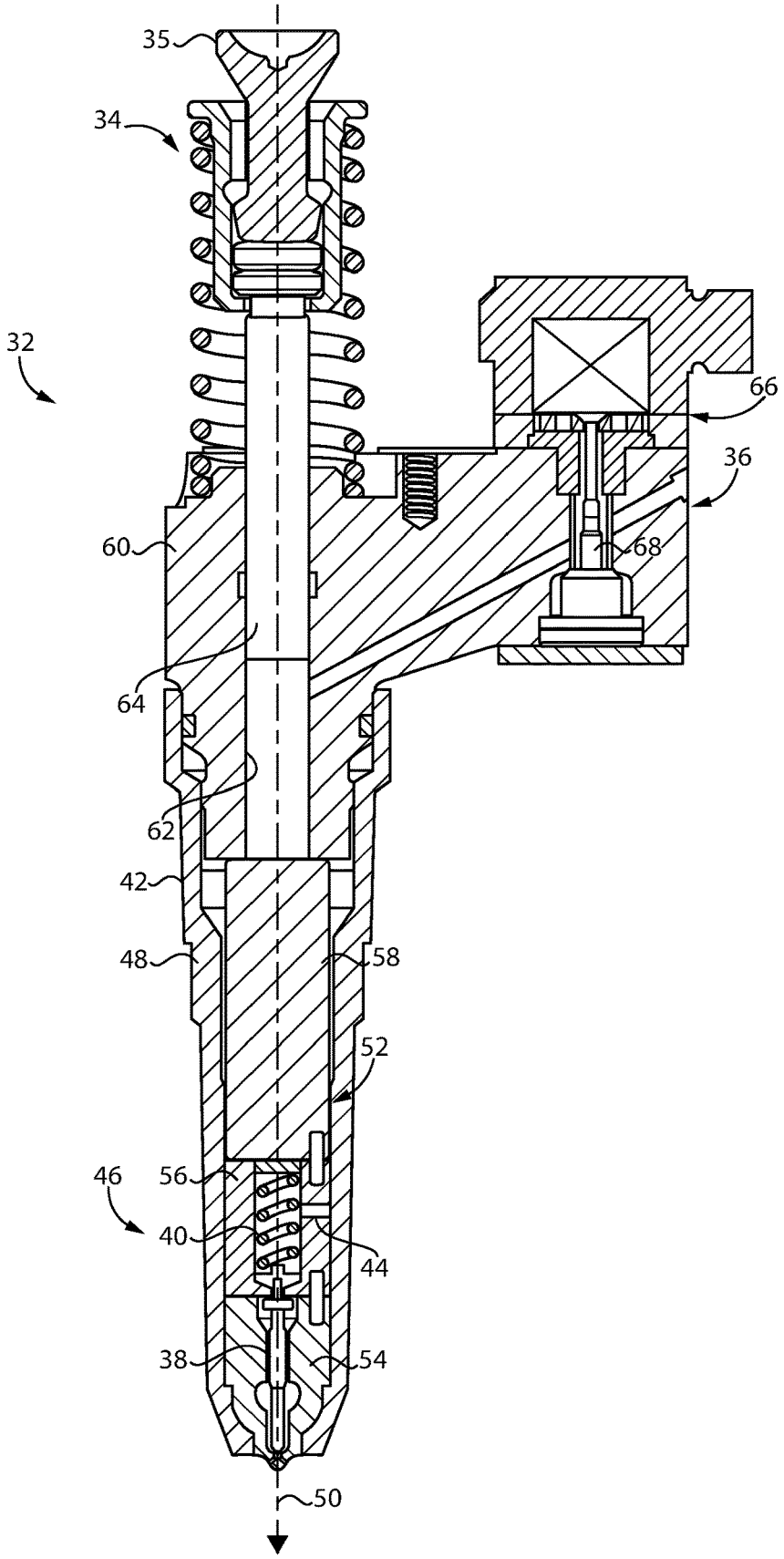
FIG. 2 is a sectioned side diagrammatic view of a fuel injector, according to one embodiment.

Referring also now to FIG. 2, there is shown a fuel injector 32 in further detail. It should be appreciated that description herein of features or functionality of any one component can be understood by way of analogy to refer to features or functionality of any other similar or identical components, except where otherwise indicated or apparent from the context. Fuel injectors 32 may be interchangeable for service within engine system 10, and thus description of fuel injector 32 in the singular refers by way of analogy to any of fuel injectors 32. Fuel injector 32 includes a nozzle assembly 46 having an injector housing 42 with a casing 48 defining a longitudinal axis 50, and a stack 52 within casing 48 and including a plurality of stack pieces. Stack 52 may include a nozzle end piece 54 and at least one mid piece 56 and 58. Fuel injector 32 may also include an injector body piece 60 that is engaged with casing 48 such as by threading to clamp the components of stack 52 within casing 48. In the illustrated embodiment mid piece 56 includes a spring piece 56 and mid piece 58 includes an upper stack piece 58. Fuel injector 32 also has formed in injector housing 42 a plunger cavity 62 with a cam-actuated plunger 64 movable within plunger cavity 62 to pressurize a fuel for injection. Plunger 64 may be coupled with a tappet 35 in contact with a corresponding cam lobe 26. An electrical actuator 66 of spill valve 36 can be operated to move a spill valve member 68 between an open position at which reciprocation of plunger 64 transitions fuel from and to fuel supply conduit 31, and a closed position at which reciprocation of plunger 64 can pressurize fuel for injection.

Figure 3:
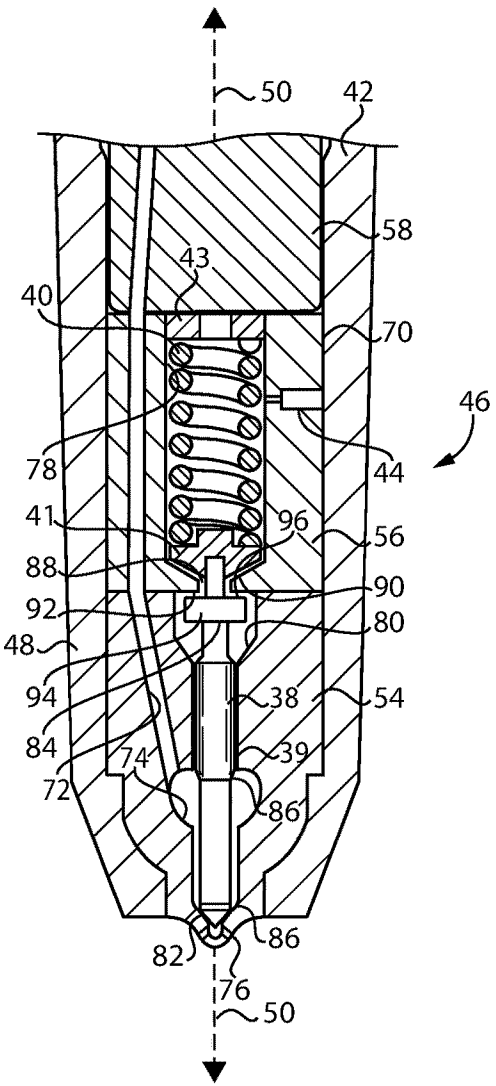
FIG. 3 is a sectioned side diagrammatic view of a nozzle assembly portion of the fuel injector of FIG. 2.

Referring also now to FIG. 3, injector housing 42 further has formed therein a nozzle supply passage 72, a nozzle cavity 74, a plurality of spray orifices 76, a spring cavity 78, and a stop cavity 80. In the illustrated embodiment nozzle supply passage 72 extends through each of the stack pieces of stack 52 and fluidly connects to nozzle cavity 74 within nozzle end piece 54. Spray orifices 76 are formed in nozzle end piece 54, however, in other embodiments spray orifices might be formed in a casing. When installed for service in engine 12 nozzle end piece 54 may be positioned such that spray orifices 76 are within a corresponding one of cylinders 16 and in fluid communication therewith. Spring cavity 78 is formed in spring piece 56, and biasing spring 40 is positioned within spring cavity 78. Biasing spring 40 is coupled to outlet check 38 to bias outlet check toward a closed position. A spring connector 41 attaches outlet check 38 to biasing spring 40 and is positioned within spring cavity 78. A spring stop or positioning piece 43 is positioned opposite to spring connector 41 and supports biasing spring 40 within spring cavity 78.

Outlet check 38 also includes a tip 82 positioned within nozzle cavity 74, and a stop 84 positioned within stop cavity 80, and outlet check 38 is movable between the closed position where tip 82 contacts injector housing 42 to block spray orifices 76, and an open position where stop 84 contacts injector housing 42. A controlled leakage path 39 extends between nozzle end piece 54 and outlet check 38 to leak fuel to stop cavity 80 and spring cavity 78. As noted above, spring cavity 78 may be formed in spring piece 56, but in other embodiments could be formed in an upper stack piece, for example, or within one or more intervening stack pieces positioned between upper stack piece 58 and nozzle end piece 54. A clearance 88 is formed between outlet check 38 and injector housing 42 and fluidly connects spring cavity 78 to stop cavity 80. In a practical implementation strategy stop cavity 80 is formed at least in part within nozzle end piece 54. Spring piece 56 includes a radially inward projection 90 extending circumferentially around outlet check 38 to form clearance 88. Radially inward projection 90 includes a housing stop surface 92 facing a first axial direction, in other words a first direction along longitudinal axis 50. Stop 84 may include a radially outward projection including a check stop surface 96 facing a second axial direction opposite to the first axial direction. Check stop surface 96 contacts housing stop surface 92 at the open position of outlet check 38.

Anti-cavitation vent 44 is located in stack 52, and is one of at least one anti-cavitation vent formed in spring piece 56, upper stack piece 58, or both. Anti-cavitation vent 44 fluidly connects spring cavity 78 to a low pressure space 70. Low pressure space 70 can include or be fluidly connected to fuel supply conduit 31, to drain conduit 33, or to a separate drain or the like. Low pressure space 70 can extend into injector housing 42 between stack 52 and casing 48 in a generally known manner. In the illustrated embodiment clearance 88 has a first flow area, and anti-cavitation vent 44 has a second flow area that is less than the first flow area, the significance of which will be further apparent from the following description. Also in the illustrated embodiment, anti-cavitation vent 44 includes an orifice formed in spring piece 56 and opening directly to spring cavity 78. In other embodiments, an anti-cavitation vent may otherwise be internal to an injector housing and fluidly connected to a spring cavity and a low pressure space within an injector housing, as further discussed herein.

Figure 4:
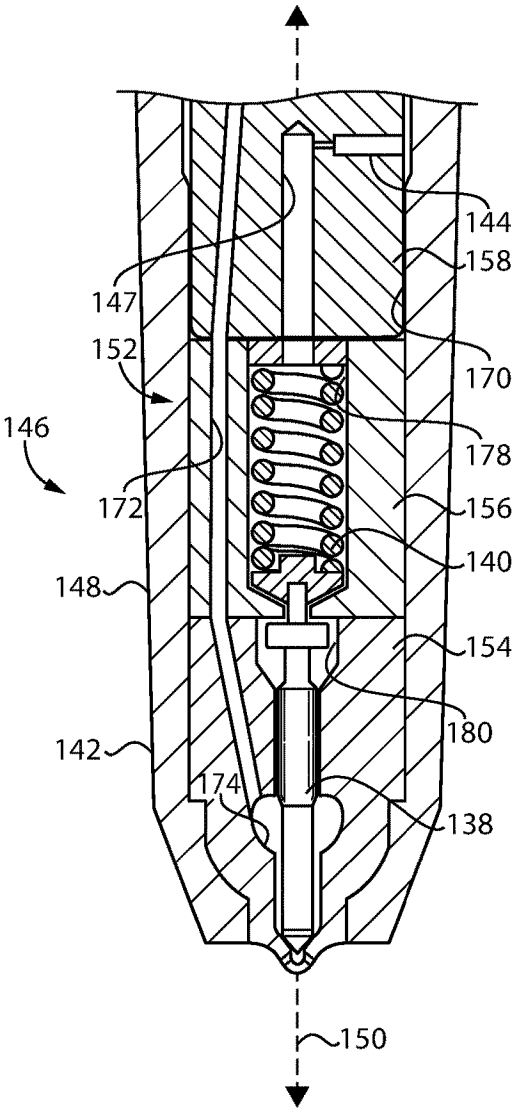
FIG. 4 is a sectioned side diagrammatic view of a nozzle assembly portion of a fuel injector, according to another embodiment.

Turning now to FIG. 4, there is shown a nozzle assembly 146 for a fuel injector according to another embodiment and including an injector housing 142 having a casing 148 defining a longitudinal axis 150, and a stack 152 within injector housing 142 and casing 148. Nozzle assembly 146 includes an outlet check 138, and stack 152 includes a nozzle end piece 154, a spring piece 156, and an upper stack piece 158. Nozzle assembly 146 also includes a nozzle supply passage 172 extending to a nozzle cavity 174, a stop cavity 180, and a spring cavity 178. A biasing spring 140 is positioned within spring cavity 178. A low pressure space 170 extends between injector housing 142 and stack 152, including between casing 148 and each of upper stack piece 158 and spring piece 156. Other features of nozzle assembly 146 not specifically described may be understood to be the same or analogous to features described in connection with the foregoing embodiment of FIG. 3. Stack 152 further has an anti-cavitation vent fluidly connecting spring cavity 178 to low pressure space 170. In the illustrated embodiment, anti-cavitation vent 144 is formed in upper stack piece 158 and opens indirectly to spring cavity 178, being connected to spring cavity 178 by way of a bore 147.

Figure 5:
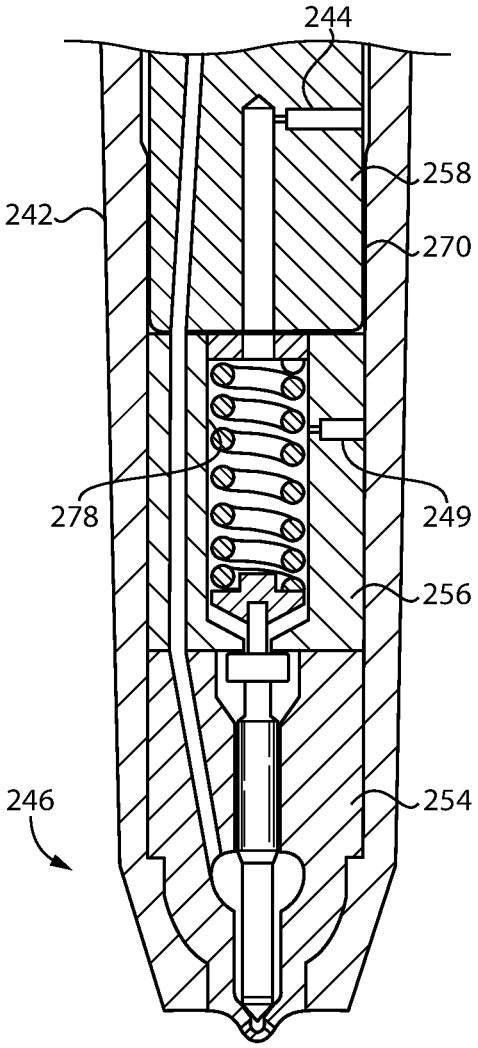
FIG. 5 is a sectioned side diagrammatic view of a nozzle assembly portion of a fuel injector, according to yet another embodiment.

Referring now to FIG. 5, there is shown a nozzle assembly 246 according to yet another embodiment and including an injector housing 242 having a casing 148 and a stack 152 therein including stack pieces 254, 256, and 258. Stack piece 254 includes a nozzle end piece, stack piece 256 includes a spring piece, and stack piece 258 includes an upper stack piece. A low pressure space 270 extends between injector housing 242 and stack pieces 256 and 258. Nozzle assembly 246 includes a first anti-cavitation vent 244 formed in upper stack piece 258, and a second anti-cavitation vent 249 formed in spring piece 256. In each of the embodiments of FIG. 3, FIG. 4, and FIG. 5, anti-cavitation vents 44, 144, 244, and 249 include an orifice internal to the corresponding injector housing 42, 142, 242 and fluidly connected to the corresponding spring cavity 78, 178, 278 and low pressure space 70, 170, 270 within the injector housing. In the case of the embodiment of FIG. 3, anti-cavitation vent 44 opens directly to spring cavity 78, in the case of the embodiment of FIG. 4 anti-cavitation vent 144 opens indirectly to spring cavity 178, and in the case of the embodiment of FIG. 5 first anti-cavitation vent 244 opens indirectly to spring cavity 278 whereas second anti-cavitation vent 249 opens directly to spring cavity 278.

INDUSTRIAL APPLICABILITY

Referring to the drawings generally, but with particular reference to the embodiment of FIGS. 1-3, operating engine system 10 and fuel injector 32 includes rotating camshaft 24 such as by way of a flywheel of engine 12, such that a cam lobe 26 rotates in contact with tappet 35 of pump 34, causing plunger 64 to advance and retract in plunger cavity 62. When spill valve 36 is in an open configuration reciprocation of plunger 64 may draw fuel into plunger cavity 62 and expel fuel from plunger cavity 62, from and to fuel supply conduit 31. When it is desirable to increase a pressure of fuel in nozzle cavity 74 for injection, spill valve 36 can be actuated closed such as by way of energizing electrical actuator 66 to move spill valve member 68 to a closed position. With spill valve 36 closed, advancing of plunger 64 in plunger cavity 62 pressurizes fuel therein, and communicates the increased pressure to nozzle cavity 74 by way of nozzle supply passage 72.

When fuel has been pressurized sufficiently in nozzle cavity 74, hydraulic pressure of the fuel acting on opening hydraulic surfaces 86 overcomes a biasing force of biasing spring 40, and actuates outlet check 38 in fuel injector 32 to an open position. Increased fuel pressure will tend to leak through leakage 39 from nozzle cavity 74 to stop cavity 80 and to spring cavity 78 such that as an increased pressure of fuel arises in nozzle cavity 74, stop cavity 80 and spring cavity 78 will also experience an increase in pressure. As outlet check 38 lifts, and particularly as outlet check 38 nears its open position where stop 84 contacts injector housing 42, fuel in spring cavity 78 is displaced through anti-cavitation vent 44 to low pressure space 70. With spray orifices 76 open, fuel will be sprayed from nozzle cavity 74 into cylinder 16. When it is desirable to end fuel injection, a pressure of fuel in nozzle cavity 74 may be reduced by actuating spill valve 36 open. In response to the reduction in pressure of fuel in nozzle cavity 74 outlet check 38 commences actuation back to its closed position, using a biasing force produced by biasing spring 40. In response to the commencing of actuating of outlet check 38 back to the closed position, and principally at the moment stop 84 moves out of contact with injector housing 42, some fuel is returned to spring cavity 78 from low pressure space 70 through anti-cavitation vent 44. During a fuel injection event a leakage or drain direction of fluid flow may be understood to extend from leakage path 39 to stop cavity 80, and from stop cavity 80 to spring cavity 78. When outlet check 38 moves toward a closed position, a return or fill direction of fluid flow may extend from stop cavity 80 to leakage path 38. Some fluid may be expelled through anti-cavitation vent 44 to low pressure space 75 as outlet check 38 closes, and returned through anti-cavitation vent 44 from low pressure space 75 as outlet check 38 begins to open, as further discussed herein.

It will be recalled that fuel pressure in spring cavity 78 will tend to increase as fuel pressure in nozzle cavity 74 is increased during a plunger pumping stroke. It has been observed in certain earlier designs that fuel pressure in a spring cavity having unrestricted venting or otherwise different vent configurations than those of the present disclosure, fuel pressure in a spring cavity can fluctuate significantly, or even drop to a negative pressure when an outlet check is moved into and out of contact with a stop. As a result, cavitation bubbles can form which, upon collapsing, can cause damage to the spring or surfaces of other components. By providing a flow restriction in the nature of the anti-cavitation vents contemplated herein, a relatively more stable and typically higher pressure can be maintained in a spring cavity during a fuel injection event than what might be observed in known design, and the magnitude of the changes in fluid pressure and potentially amplitudes of variations in fluid pressure that can lead to production of cavitation bubbles may be reduced. Vents, orifices, flow areas, not capable of producing this general functionality would not be fairly understood as an anti-cavitation vent.

Figure 6:
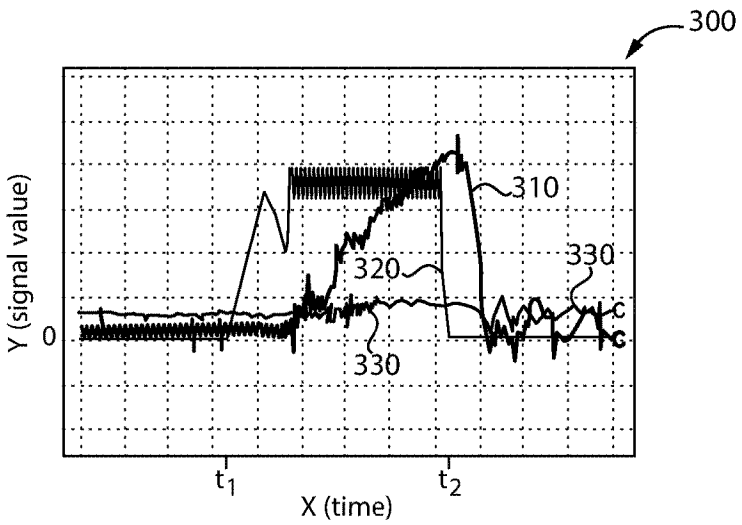
FIG. 6 is a graph of signal value over time for properties of a nozzle assembly during fuel injection, according to one embodiment.
Figure 7:
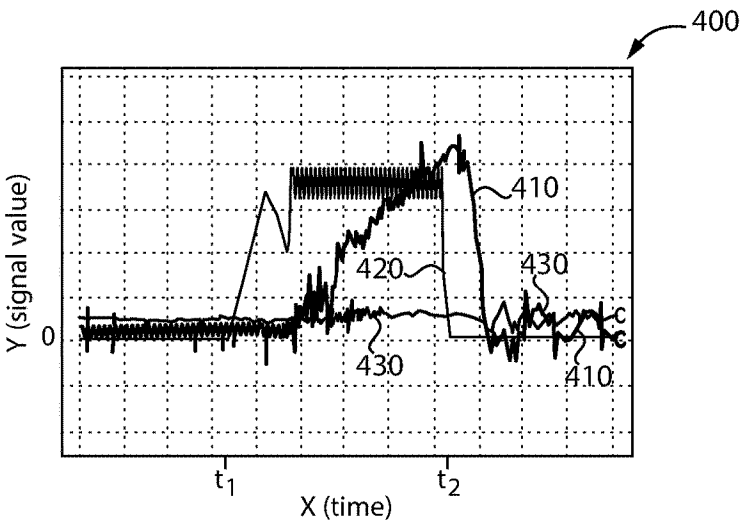
FIG. 7 is a graph of signal value over time for properties of a nozzle assembly during fuel injection, according to another embodiment.

Referring now to FIG. 6, there is shown a graph 300 illustrating a first signal trace 310 indicative of peak pressure in a nozzle cavity in a fuel injector similar to the embodiment of FIG. 3, a second trace 320 indicative of a response time and/or position of an outlet check in the fuel injector, and a third trace 330 indicative of fluid pressure inside the spring cavity, during a fuel injection event. At a time $t_1$, it can be noted that nozzle cavity pressure has just begun to increase and check position has just begun to move from a closed position. At approximately a time $t_2$, nozzle pressure has peaked, or is close to peaking, and outlet check position begins to return from the open position toward the closed position. Time $t_2$ is approximately the time at which stop 84 comes out of contact with injector housing 42, leaving the open position and commencing travel toward the closed position. Between time $t_1$, and time $t_2$, spring cavity pressure is relatively stable, and it can be seen that spring cavity pressure drops slightly after time $t_2$, but then generally recovers without reaching a negative pressure state and without experiencing relatively large fluctuations. Referring to FIG. 7, there is shown another graph 400 including a peak pressure trace 410, an outlet check timing or position trace 420, and a spring cavity pressure trace 430 and times $t_1$ and $t_2$. The properties depicted in FIG. 7 might be observed in the embodiment of FIG. 4. It can be noted that patterns very similar to those observed in FIG. 6 are evident in FIG. 7. Cavitation in the spring cavity is expected to be reduced or eliminated in each case over what might be observed in other designs having no cavitation mitigation features, or ones which are inferior, as discussed herein.

Figure 8:
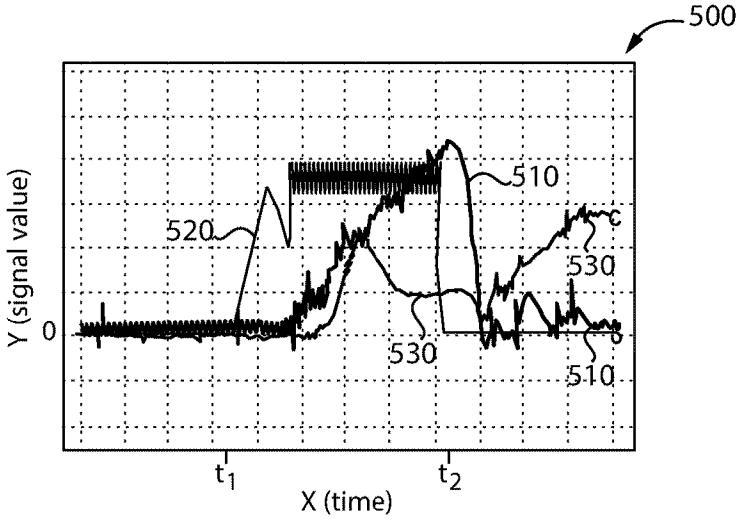
FIG. 8 is a graph of signal value over time for properties of a nozzle assembly during fuel injection, according to a known design.

Turning to FIG. 8, there is shown a graph 500 including a nozzle cavity pressure trace 510, an outlet check timing or position trace 520, and a spring cavity pressure trace 530. Between a time $t_1$, and a time $t_2$, corresponding generally to times of initiating opening and initiating closing an outlet check in the known fuel injector, it can be seen that spring cavity pressure 530 rises significantly, drops approaching $t_1$, and then increases following time $t_1$. In the FIG. 8 design, the fuel injector might be formed having a vent fluidly connecting directly between a stop cavity and a low pressure space, in a nozzle end piece, instead of connecting directly or indirectly to a spring chamber in accordance with the present disclosure. A fuel injector as in FIG. 8 can be expected to be inferior to embodiments of the present disclosure based at least in part on the selected location for venting. With a stop chamber vented directly, there may be greater difficulty or impossibility in the venting assisting and maintaining a relatively higher pressure in a spring cavity, and thus preventing the occurrence of negative spring cavity pressure or other conditions leading to cavitation.

Figure 9:
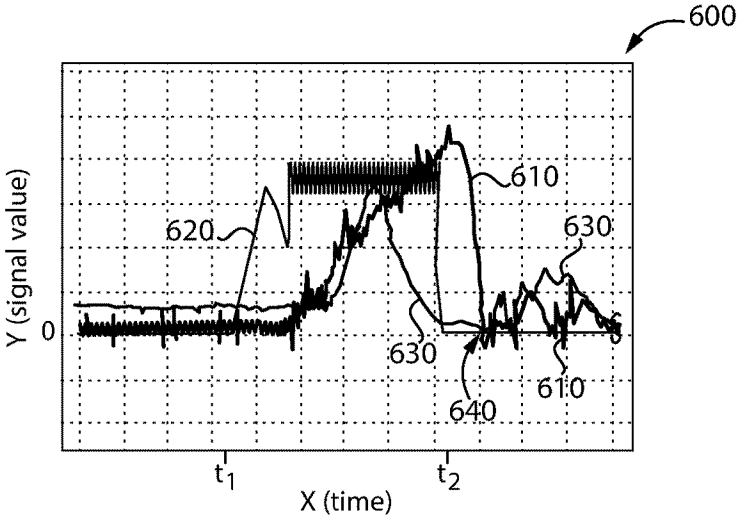
FIG. 9 is a graph of signal value over time for properties of a nozzle assembly during fuel injection, according to another known design.

Referring to FIG. 9, there is shown yet another graph 600 including a nozzle cavity peak pressure trace 610, an outlet check position or timing trace 620, and a spring cavity pressure trace 630. The properties depicted in FIG. 9 might be observed where no flow restriction between a low pressure space and a spring cavity is provided at all. In other words, in a fuel injector corresponding to FIG. 9 rather than a flow restriction to a spring chamber, a substantially unrestricted fluid connection to a low pressure space is used. It can be observed that spring cavity pressure increases relatively dramatically between a time $t_1$, and a time $t_2$, then decreases rapidly toward time $t_1$, and reaches or approaches negative pressure thereafter at a region 640, where cavitation can be expected to be likely.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. A nozzle assembly for a fuel injector comprising:

an injector housing including a casing defining a longitudinal axis, and a stack within the casing;

the stack including a nozzle end piece and at least one mid piece, and having formed therein a nozzle supply passage, a nozzle cavity, a plurality of spray orifices, a spring cavity, and a stop cavity;

an outlet check having a tip positioned within the nozzle cavity, a stop positioned within the stop cavity, and an opening hydraulic surface exposed to a fluid pressure of the nozzle cavity, and the outlet check being movable between a closed position where the tip contacts the injector housing to block the plurality of spray orifices, and an open position where the stop contacts the injector housing;

a biasing spring positioned within the spring cavity and coupled to the outlet check to bias the outlet check toward the closed position;

the injector housing includes a housing stop surface facing a first axial direction;

the stop includes a radially outward projection having a first stop surface facing a second axial direction opposite to the first axial direction, such that the first stop surface contacts the housing stop surface at the closed position and is exposed to the stop cavity at the open position, and a second stop surface facing the first axial direction and exposed to the stop cavity at each of the closed position and the open position;

a leakage path extends between the nozzle end piece and the outlet check and fluidly connects the nozzle cavity to the stop cavity;

a clearance is formed between the outlet check and the injector housing and fluidly connects the spring cavity to the stop cavity, the clearance having a first flow area; and the stack further has an anti-cavitation vent formed in the at least one mid piece, the anti-cavitation vent fluidly connecting the spring cavity to a low pressure space and having a second flow area that is less than the first flow area.

2. The nozzle assembly of claim 1 wherein the spring cavity is formed in the at least one mid piece, and the stop cavity is formed at least in part within the nozzle end piece.

3. The nozzle assembly of claim 1 wherein the at least one mid piece includes a spring piece having the spring cavity formed therein, and the spring piece includes a radially inward projection extending circumferentially around the outlet check to form the clearance.

4. The nozzle assembly of claim 3 wherein the anti-cavitation vent includes an orifice formed in the spring piece and opening directly to the spring cavity.

5. The nozzle assembly of claim 3 wherein the at least one mid piece includes an upper stack piece and the anti-cavitation vent includes an orifice formed in the upper stack piece and opening indirectly to the spring cavity.

6. The nozzle assembly of claim 3 wherein the radially inward projection includes the housing stop surface, and wherein the low pressure space extends between the at least one mid piece and the casing.

7. The nozzle assembly of claim 6 wherein the stop includes a radially outward projection formed on the outlet check.

8. A fuel injector for an internal combustion engine comprising:

an injector housing including a longitudinal axis and having formed therein a plunger cavity, a nozzle supply passage, a nozzle cavity, a plurality of spray orifices, a spring cavity, and a stop cavity;

a plunger movable within the plunger cavity to pressurize a fuel for injection;

a tappet coupled to the plunger and structured to contact a cam lobe of a camshaft;

an outlet check having a tip positioned within the nozzle cavity, a stop positioned within the stop cavity, and an opening hydraulic surface exposed to a fluid pressure of the nozzle cavity, and the outlet check being movable between a closed position where the tip contacts the injector housing to block the plurality of spray orifices, and an open position where the stop contacts the injector housing;

a biasing spring positioned within the spring cavity and coupled to the outlet check to bias the outlet check toward the closed position;

a clearance is formed between the outlet check and the injector housing and fluidly connects the spring cavity to the stop cavity;

an anti-cavitation vent is formed in the injector housing and structured to limit fluid pressure changes in the spring cavity;

the anti-cavitation vent fluidly connects the spring cavity to a low pressure space, such that fluid is displaced from the spring cavity through the anti-cavitation vent in response to positioning the outlet check at the open position, and fluid is returned through the anti-cavitation vent to the spring cavity in response to commencing moving the outlet check from the open position back to the closed position;

a leakage path extends between the nozzle end piece and the outlet check and fluidly connects the nozzle cavity to the stop cavity; and the outlet check includes a reduced diameter portion extending through the clearance, and an enlarged diameter portion forming the stop, and the enlarged diameter portion is positioned within the stop cavity at each of the open position and the closed position.

9. The fuel injector of claim 8 further comprising an electrically actuated spill valve assembly positioned fluidly between the plunger cavity and the low pressure space.

10. The fuel injector of claim 8 wherein:

the injector housing includes a spring piece having the spring cavity formed therein, and a nozzle end piece having the nozzle cavity formed therein; and the stop cavity is formed by the nozzle end piece and the spring piece, and is unconnected to the low pressure space between the clearance and a leakage path to the nozzle cavity formed by the outlet check and the nozzle end piece.

11. The fuel injector of claim 8 wherein the anti-cavitation vent includes an orifice opening directly to the spring cavity.

12. The fuel injector of claim 8 wherein the anti-cavitation vent includes an orifice opening indirectly to the spring cavity.

13. The fuel injector of claim 8 wherein the stop includes a radially outward projection formed on the outlet check, and the injector housing includes a radially inward projection extending circumferentially around the outlet check to form the clearance.

14. The fuel injector of claim 13 wherein the radially outward projection includes a check stop surface, and the radially inward projection includes a housing stop surface, and wherein the check stop surface contacts the housing stop surface at the open position of the outlet check.

15. The fuel injector of claim 8 wherein the anti-cavitation vent includes an orifice internal to the injector housing and fluidly connected to the spring cavity and the low pressure space within the injector housing.

16. The fuel injector of claim 15 wherein a drain direction of fluid flow extends from a leakage path formed by the outlet check and the nozzle end piece to the stop cavity, and from the stop cavity to the spring cavity.

17. A method of operating a fuel injector for an internal combustion engine comprising:

increasing a pressure of fuel in a nozzle cavity in the fuel injector;

actuating an outlet check in the fuel injector to an open position in response to the increased pressure of fuel in the nozzle cavity;

conveying fuel from the nozzle cavity through a leakage path, between an outlet check and a housing of the fuel injector, to a stop cavity, and from the stop cavity to a spring cavity, in response to the increased pressure of fuel in the nozzle cavity;

displacing fuel in the spring cavity through an anti-cavitation vent to a low pressure space in response to positioning the outlet check at the open position;

restricting a flow of the displaced fuel through the anti-cavitation vent so as to limit a decrease in a fluid pressure in the spring cavity;

reducing a pressure of fuel in the nozzle cavity;

commencing actuating the outlet check back to a closed position in response to the reduction in the pressure of fuel in the nozzle cavity using a biasing spring in the fuel injector;

returning fuel to the spring cavity from the low pressure space in response to the commencing of the actuating of the outlet check back to the closed position;

conveying the returning fuel to the spring cavity through an anti-cavitation vent in the fuel injector; and limiting production of cavitation bubbles in the spring cavity during actuating the outlet check back to the closed position based on the limiting of the decrease in a fluid pressure in the spring cavity.

18. The method of claim 17 wherein the increasing of the pressure of fuel includes supplying fuel pressurized by a cam-actuated plunger to the nozzle cavity, and starting the increasing of the pressure of fuel by closing a spill valve assembly.

19. The method of claim 18 wherein the conveying of the returning fuel includes conveying the returning fuel through an anti-cavitation vent that opens directly to the spring cavity.

20. The method of claim 17 wherein the conveying of the returning fuel to the spring cavity further includes restricting a rate of flow of the returning fuel so as to limit a reduction in fluid pressure in the spring cavity.

* * * * *